United States Patent [19]

Genis et al.

[11] 4,175,455

[45] Nov. 27, 1979

[54] TRAVELLING CUT-OFF SAW

[75] Inventors: James Genis, Clinton; William T. Mars, Cuyahoga Falls, both of Ohio

[73] Assignee: McNeil Corporation, Akron, Ohio

[21] Appl. No.: 888,829

[22] Filed: Mar. 22, 1978

[51] Int. Cl.[2] ..... B28B 11/14

[52] U.S. Cl. ..... 83/110; 83/295; 83/307.2; 83/318; 83/424

[58] Field of Search ..... 83/318, 319, 320, 295, 83/424, 307.1, 307.2, 801, 110

[56] References Cited

U.S. PATENT DOCUMENTS

| | | | |
|---|---|---|---|
| 1,077,226 | 10/1913 | King | 83/307.3 |
| 1,214,668 | 2/1917 | Fredrikson | 83/307.1 |
| 3,081,657 | 3/1963 | Harris | 83/319 X |
| 3,118,337 | 1/1964 | Ferris | 83/801 X |
| 3,251,255 | 5/1966 | Bauman | 83/295 |
| 3,354,765 | 11/1967 | Frey et al. | 83/318 X |
| 4,114,490 | 9/1978 | Braun et al. | 83/318 |

*Primary Examiner*—J. M. Meister

*Attorney, Agent, or Firm*—Hamilton, Renner & Kenner

[57] ABSTRACT

A continuous material, such as a block of urethane foam, is moved at a constant speed in a longitudinal direction on an infeed conveyor. A stationary cutting platen is situated at the end of the infeed conveyor. A cutting saw is movable in the longitudinal and vertical direction above the platen. A piece of the material, once cut, is carried away by an outfeed conveyor adjacent the platen. The movement of the conveyors and the longitudinal and vertical movements of the cutting saw are coordinated so that the cut of the material is always completed over the cutting platen.

6 Claims, 3 Drawing Figures

TRAVELLING CUT-OFF SAW

BACKGROUND OF THE INVENTION

This invention relates to an apparatus for severing a continuous material stock into sections. More particularly, this invention relates to a travelling saw for cutting materials such as urethane foam.

In all prior designs of urethane foam cutting devices of which we are aware, the cutting platen is movable, usually travelling with the blade. Inasmuch as the platen is generally associated, at least in location, with the conveyor system of a continuous line, the moving platen added undesirable complexity to the conveyor design, added to the length and bulk of the overall machine, added to maintenance problems since particles of the cut material would often accumulate in the platen system, and added significantly to the cost thereof. In addition, the design of the conveyor, platen, and the like to permit the platen to travel with the blade had to be compromised at a cost of accuracy of the cuts.

SUMMARY OF THE INVENTION

It is thus a primary object of the present invention to provide a device for severing a continuous material into sections utilizing a travelling cut-off saw wherein the cutting platen is stationary and yet the cut of the material is made over the platen.

It is another object of the present invention to provide a device, as above, which provides highly accurate cuts at less cost than prior art designs.

It is a further object of the present invention to provide a device, as above, in which the drive for the infeed conveyor and the travelling saw may be combined.

It is still another object of the present invention to provide a device, as above, which can be provided with a conveyor system of simpler design than the prior art, thus rendering a more compact device.

It is an additional object of the present invention to provide a device, as above, which requires less maintenance since particle accumulation in the travelling platen of the prior art is avoided.

These and other advantages of the present invention, which will become apparent from the description to follow, are accomplished by the means hereinafter described and claimed.

In general, the device which severs a continuous material in sections includes an infeed conveyor which continuously carries the material in a longitudinal direction toward a cutting platen located at the end thereof. A cutting saw is located above the material and is movable longitudinally and vertically to sever the material over the cutting platen. A control device coordinates the longitudinal movement of the infeed conveyor and the movements of the cutting saw to assure that the cut is made over the platen. The severed sections are then carried away by an outfeed conveyor.

DESCRIPTION OF THE PREFERRED EMBODIMENT

Figure 1:
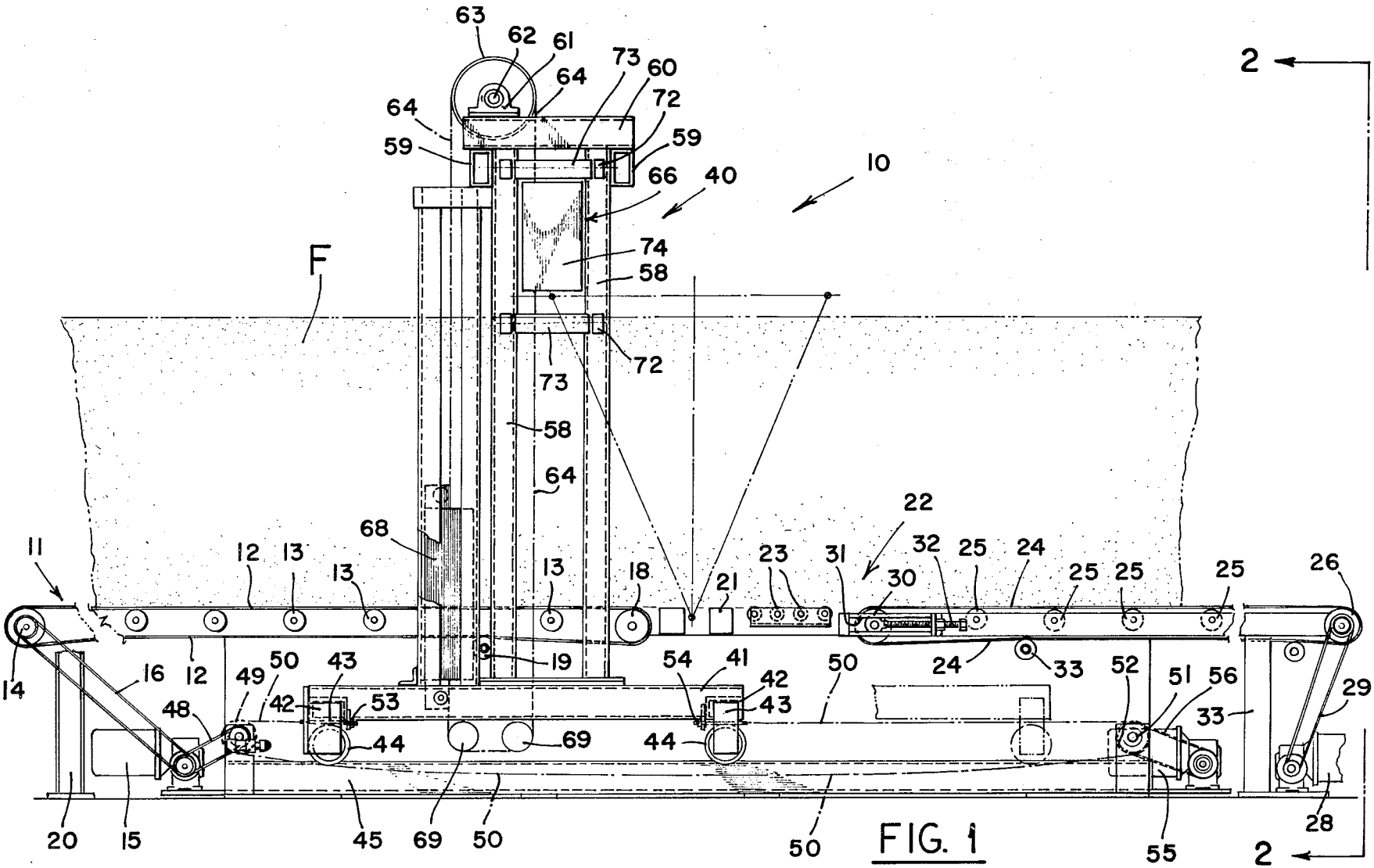
FIG. 1 is a side elevational view of the cutting device according to the concept of the present invention.
Figure 2:
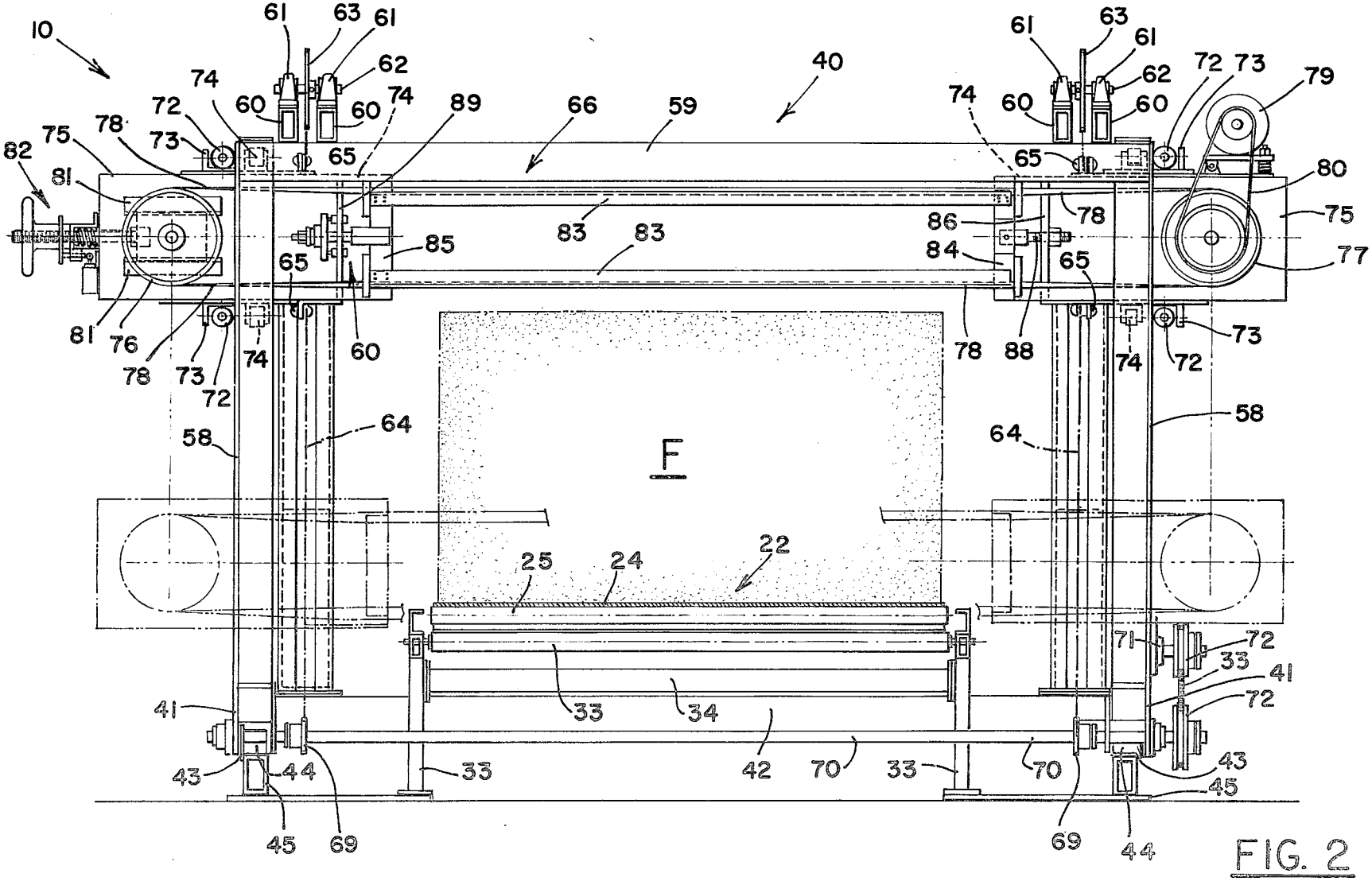
FIG. 2 is an elevational view taken substantially along line 2—2 of FIG. 1.

The machine for cutting a continuous material into sections is indicated generally by the numeral 10 in FIGS. 1 and 2 and is shown as operating on a block of urethane foam F, but which could be any type of continuous cuttable material. Foam F is carried in a longitudinal direction through the machine by an infeed conveyor indicated generally by the numeral 11 and shown somewhat schematically in FIG. 1. Infeed conveyor 11 can be any type of conventional conveying system but is shown as having a belt 12 riding over idler rollers 13. Belt 12 extends around a drive pulley 14 which is driven by motor 15 by means of chain 16. Belt 12 also extends around pulley 18 at its other end. Although not shown in the drawings for clarity therein, pulley 18 is adjustable to vary the tension on belt 12. An idler roller 19 bears against the return side of belt 12 to further compensate for any slack therein. Conveyor 11 is supported by a plurality of frame members such as stanchion 20 shown in FIG. 1.

A stationary cutting platen 21 is situated at the end of infeed conveyor 11. As will hereinafter be described in detail, the foam F while moving on conveyor 11 in the longitudinal direction is cut over platen 21 into sections. The sections are then taken away by an outfeed conveyor indicated generally by the numeral 22 and shown somewhat schematically in FIGS. 1 and 2. Outfeed conveyor 22 includes a plurality of idler rollers 23 adjacent platen 21 and a conveyor belt 24 riding over idler rolls 25. Belt 24 extends around a drive pulley 26 which is driven by motor 28 by means of chain 29. In order to gain separation of the severed sections of the material, conveyor belt 24 is driven at a much faster speed than infeed conveyor belt 12 at the time a section is severed. As the unsevered material reaches belt 24, it is returned to the speed of belt 12. Belt 24 also extends around pulley 30. Like pulley 18, pulley 30 is adjustable, the axis thereof being movable in track 31 by means of adjusting screw 32. An idler roller 33 bears against the return side of belt 24 to further compensate for any slack therein. Conveyor 22 is supported by a plurality of frame members such as stanchions 33, best shown in FIG. 2, spanned by crossbeam 34.

A cutting saw assembly, indicated generally by the numeral 40, is located above conveyors 11 and 22 and platen 21 and is adapted to move longitudinally and vertically to complete a cut of foam F over platen 21. Saw assembly 40 is mounted on a box-like frame including longitudinally extending frame members 41 spanned by transversly extending frame members 42. Each corner or junction of frames 41 and 42 is provided with a bracket 43 for mounting wheels 44 which ride on longitudinally extending rails 45.

Cutting saw assembly 40 is selectively moved longitudinally forward (to the right in FIG. 1) on rails 45 through appropriate clutching of motor 15 which also controls the movement of infeed conveyor 11. A shaft 46 is chain driven, as at 48, and has a drive sproket 49 thereon to power drive chain 50. A similar shaft 51 at the front of the main frame carries sprocket 52 around which chain 50 is received. The ends of chain 50 are attached to frame members 42, as at 53 and 54. Thus, assembly 40 is moved forward by motor 15 at the same rate as infeed conveyor 11. A motor 55, through chain drive 56, rotates shaft 51 to return assembly 40 to its original longitudinal position after appropriate clutching has disengaged shaft 46 from the power of motor 15.

Each frame member 41 carries two vertical guide frames 58 which support, at the top thereof, horizontal crossbeams 59. Beams 60 extend between crossbeams 59 and carry pillow blocks 61. Axles 62 are supported between each pair of pillow blocks 61 to rotatably carry a chain sprocket 63. A chain 64 is received around each sprocket 63 and is attached as at 65, to the cutting head assembly, indicated generally by the numeral 66. Each chain 64 also carries a counterweight 68 and extends from counterweight 68 around sprockets 69. Thus, a continuous chain loop is formed from sprockets 43, to cutting head assembly 66, to sprockets 69, to counterweights 68 and back to sprockets 43.

Sprockets 69 are mounted on a shaft 70 which is driven by a motor 71 through an appropriate pulley and belt arrangement, 72 and 73, respectively. Thus, activation of motor 71 rotates shaft 70 to raise and lower the cutting head assembly 66, for example, from the solid line upward position to the chain line lower, cutting position shown in FIG. 2. A plurality of rollers 72 rotatably mounted from angles 73 ride on one side of guide frames 58 with additional rollers 74 running on another side of frames 58 to maintain alignment of cutting head assembly 66 during its vertical movement.

As best shown in FIG. 2, the movable cutting head assembly 66 includes a saw housing 75 at each end thereof which enclose ribbon pulleys 76 and 77 that carry the ribbon or band saw blade 78. Pulley 77 is driven by motor 79 through an appropriate belt connection 80. Pulley 76 is movable along guides 81 to adjust the tension on the blade by means of a conventional tension adjusting assembly 82. Saw housings 74 also carry ribbon guides 83 which are mounted on end plates 84 and 85. A bar 86 extending across one housing 75 holds ribbon guides thereto, as by bolt 88. A similar bar 89 holds plate 85 to the other housing 75, with this connection being adjustable, as by a conventional adjustment assembly 90, so that the tension on ribbon guides 83 may be adjusted.

Figure 3:
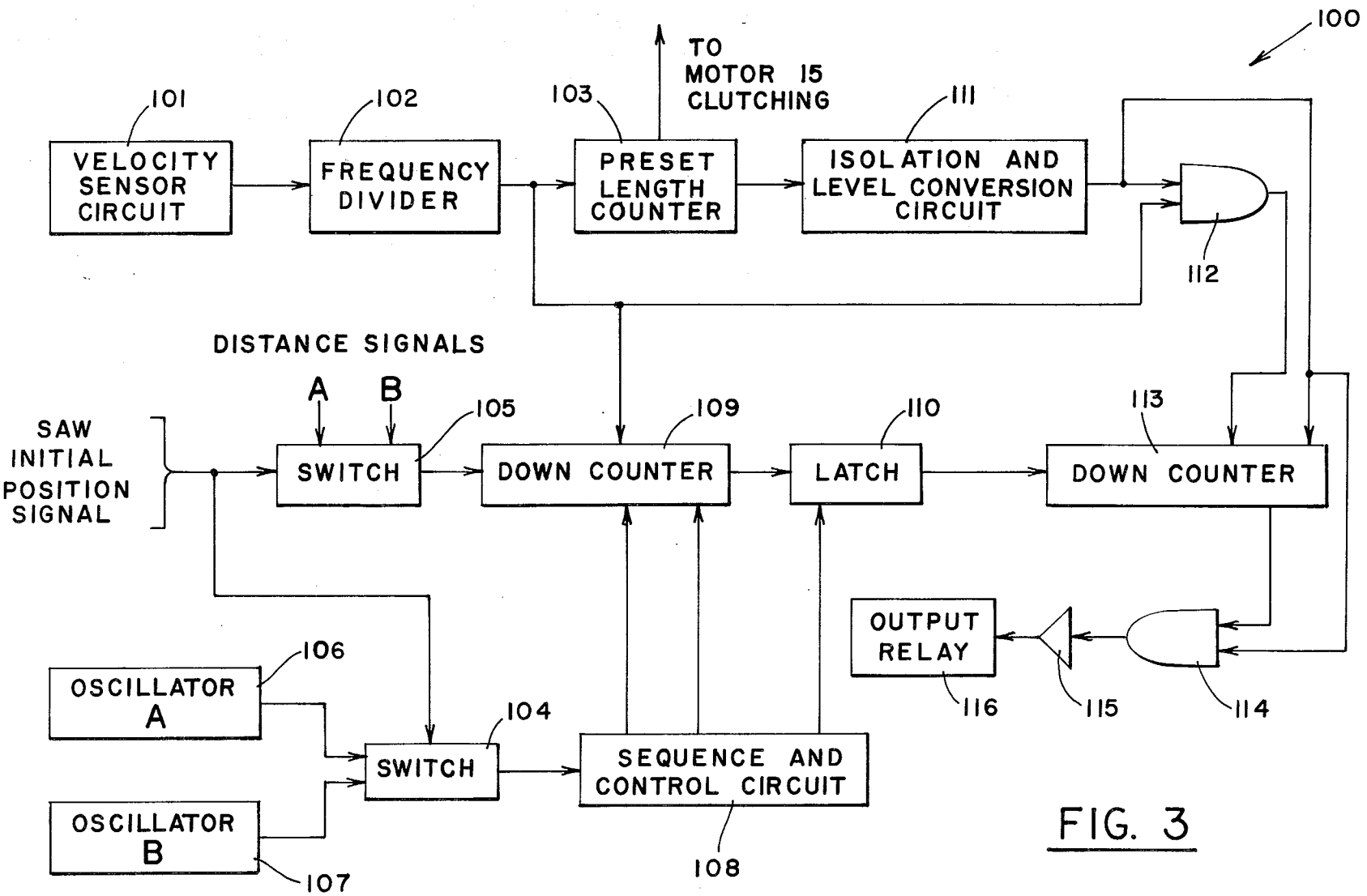
FIG. 3 is a block diagram of the control circuit for the device shown in FIGS. 1 and 2.

The electronic control of the device just described, which assures that each cut of the material is made over the platen, is indicated generally by the numeral 100 in FIG. 3 and will now be described in detail. The overall movement of the saw is, in general, dependent on the speed of infeed conveyor 11. Usually after a certain rest period, the saw will first move longitudinally at the same speed as the conveyor and then at a certain time move downward while still moving longitudinally to effect the cut. The saw shown in FIG. 1 is at a position where the downward movement will just start. A velocity sensor circuit 101 detects the speed of infeed conveyor 11 and provides an output signal the frequency of which is proportional to conveyor speed. As would be well known to one skilled in the art, velocity sensor circuit 101 includes a sensing unit which can be a magnetic pickup, photoelectric cell or the like which monitors some moving portion of the conveyor such as a gear. Circuit 101 would usually also include a conventional wave shaping circuit, such as a regenerative comparator, which would convert the generally sinusoidal wave generated by the sensing unit to a square wave suitable for use by other circuitry. The output of velocity sensor circuit 101 which is proportional to the speed of infeed coveyor 11 and thus the speed of the movement of the material is provided to a conventional frequency divider 102 which merely divides the signal of circuit 101 so that by counting a convenient number of pulses, a specified distance of travel of conveyor 11 can be obtained. For example, one hundred pulses could be made equivalent to one foot of travel of conveyor 11.

The signal whose frequency is proportional to conveyor speed out of divider 102 is fed to a preset length counter 103. A preselected number is set into counter 103 dependent on the length of the product to be cut. If, for example, ten-foot lengths of product are to be cut, then a target count of 1000 would be set into counter 103 assuming one hundred pulses equal one foot of conveyor travel, as previously described as typical. Thus, counter 103 counts pulses from divider 102 until a match with the preselected target count occurs. Upon such a match, a control signal is sent to the clutch of motor 15 to engage shaft 46 and begin the longitudinal movement of cutting saw assembly 40. The manner in which this longitudinal movement is coordinated with vertical movement of the saw assembly will now be described.

The initial height of the saw above the conveyor must, of course, be higher than the thickness or height of the material being cut. Because it is advantageous for speedy and efficient operation of the device to have the saw relatively close to the top of the material, no matter what its height, it is advantageous to provide a plurality of starting points for the saw assembly. To this end, the circuit 100 can be made to account for multiple vertical starting points for the saw with two alternative starting points, "A" and "B" , being chosen for purposes of description herein, it being assumed that point A is the highest extent of the saw with point B being half the distance of point A.

When the operator of the machine sets the vertical height of the saw assembly at its desired initial position, a limit switch or other proximity sensing device can provide a saw initial position signal, in this instance either indicative of the A position or the B position. The saw initial position signal is used as an enable signal for two electronic switches, 104 and 105, which as is well-known in the art, can be a series of logic gates designed to permit the passage of a particular signal upon the occurrence of a particular enable signal. In the instance of switch 104, signals from two oscillators 106, 107 are selectively permitted to pass therethrough dependent on the initial position signal. Thus, if the initial position signal indicates that the saw is satrting from the fully upward position, A, then the signal from oscillator A 106 is premitted to pass through switch 104 to a sequence and control circuit 108, to be hereinafter described. Similarly, the signal from oscillator B 107 would pass to sequence and control circuit 108 if enabled to do so by a B initial position signal. The signals out of oscillator A 106 and oscillator B 107 are square waves whose frequencies are proportional to the time which will be required for the saw to make its vertical descent. Preferably, a very slow frequency is selected. For example, oscillator A 106 could be set to provide a pulse every two seconds, with oscillator B 107 providing a pulse every second.

Two present distance signals are fed to switch 105. These signals are proportional to the longitudinal distance between the initial position of the saw and the platen. Usually with the saw in the upward A position, it is also positioned horizontally or longitudinally farther away from the platen than it would be if in a lower position, such as the B position. Dependent on the saw initial position signal being fed to switch 105, one or the other of the distance signal's will be permitted to pass to down counter 109. This loads counter 109 with a number representative of distance to be traveled, that is, the longitudinal distance the saw is from the platen. Using an example compatible with previous examples, if the saw had to move a total of two feet in the longitudinal direction, the number 200 would be loaded into counter 109.

The purpose of counter 109 is to present a number to latch 110 which is indicative of the amount of longitudinal movement of the saw after the signal from counter 103 and until the beginning of the downward movement. Counter 109 is controlled by sequence and control circuit 108 which consists of a counter and oscillator connected in a manner known in the art so that upon receiving a relatively slow pulse from either control oscillator A 106 or oscillator B 107, three very fast pulses are transmitted. Specifically, when circuit 108 receives a pulse through switch 104 the following essentially instantaneous sequence of events occurs: first, counter 109 is inhibited; second, the count then existing on counter 109 is loaded into latch 110; third, the preset distance signal is loaded into counter 109 through switch 105; and finally, counter 109 is permitted to count down again at a rate dependent on the speed of the conveyor according to the signal from frequency divider 102. Thus, a number is continually stored in latch 110 which is indicative of the horizontal distance the saw will have to travel before beginning its vertical movement. Normally, that distance will be constant as long as the conveyor speed is constant; but should the conveyor speed vary slightly, this will be reflected by a different number being stored in latch 110.

Using the parameters of the example previously given, that is, assuming that conveyor 11 is moving at a rate of one foot every ten seconds, that the signal out of divider 102 is at a rate of 100 pulses per foot of travel of conveyor 11, that the signal out of oscillator A 106 occurs once every two seconds, that down counter 109 is loaded with the number 200 indicative of two feet of distance between the initial position of the saw and the platen, and that counter 103 is preset at 1000 to cut ten-foot lengths of material, the circuitry described thus far would operate as follows: Pulses out of divider 102 would be fed to counters 103 and 109 at a rate of 100 pulses every ten seconds. Every two seconds counter 109 would be loaded with the number 200 and would count down to 180 between signals from oscillator A 106. The number 180 would be continually stored in latch 110. This would mean that the saw would travel 1.8 feet horizontally before starting its vertical descent.

After the conveyor has moved ten feet, counter 103 would sense a match engaging the clutch of motor 15 to begin the saw on its horizontal movement. Counter 103 would also provide a signal, through isolation and level conversion circuit 111, to an AND gate 112. Circuit 111 merely converts machine voltage down to logic voltage for use by gate 112. Also, at the instant a match signal is transmitted by counter 103, it is immediately reset to zero to start another count and a down counter 113 is loaded with the number currently being stored in latch 110. Because the second input to AND gate 112 is the signal from divider 102 proportional to conveyor speed, counter 113 is decremented at a rate proportional to conveyor movement. At this time, of course, the saw is moving horizontally with the conveyor due to the engagement of the clutch of motor 15. When counter 113 reaches zero, a zero detect signal is fed to an AND gate 114, which when coupled with a signal from counter 103, permits a signal to pass through amplifier 115 to activate an output relay 116 to start motor 71 to move the saw downward to cut the material.

At this point the saw is no longer in the control of circuit 100, but rather descends under the control of motor 71 to make its cut directly over the platen. Once the cut is made, the saw returns vertically upward. At this point the saw return motor 55 takes over to return the saw to its initial position to await another signal from counter 103. Of course all the while the saw is moving horizontally, vertically, and then back to its original position, counter 103 has been counting upward toward its next match, and counter 109 has been loading updated data into latch 110 relative to the speed of the conveyor so that upon another signal out of counter 103, the controlled movement of the saw can begin again to assure that every cut is made over the platen.

It should thus be evident that a device constructed and controlled as described herein will accomplish the objects of the present invention and otherwise substantially improve the art.

We claim:

1. Apparatus for severing a continuous material into sections comprising, an infeed conveyor carrying the continuous material in a longitudinal direction, stationary cutting platen means at the end of said infeed conveyor, cutting means above the material and movable longitudinally and vertically to sever the material into sections, outfeed conveyor means adjacent said platen means to carry away the severed sections, sensor means providing an output signal indicative of the speed of said infeed conveyor, first counter means receiving the output signal of said sensor means and providing an output signal when the material carried by said infeed conveyor has travelled a predetermined distance, said predetermined distance being selected according to the desired length of the severed sections of material, the output signal of said first counter means initiating the longitudinal movement of said cutting means, and second counter means receiving a signal indicative of the longitudinal distance between the initial position of said cutting means and said stationary platen means and receiving the output signal of said sensor means to provide an output signal indicative of the amount of longitudinal movement of said cutting means from the point of the initial longitudinal movement thereof and until the point of initial vertical movement thereof so that the vertical movement of said cutting means may be initiated thereby assuring that cutting of the material is completed over said stationary platen means.

2. Apparatus according to claim 1 further comprising drive means to move said infeed conveyor at a substantially constant speed, said drive means also moving said cutting means longitudinally at the same speed upon receipt of the output signal from said first counter means.

3. Apparatus according to claim 2 further comprising second drive means to move said cutting means vertically, the operation of said second drive means being initiated by the output signal of said third counter means.

4. Apparatus according to claim 3 further comprising third drive means to move said cutting means in the opposite direction as said cutting means is moved by said drive means after the cutting is completed over said stationary platen means.

5. Apparatus according to claim 1 further comprising means selectively generating a signal indicative of the initial vertical position of said cutting means, circuit means controlling said second counter means, and latch means storing the output signal of said second counter means.

6. Apparatus according to claim 5 further comprising third counter means receiving the output signal of said first counter means and the signal stored in said latch means and providing an output signal to initiate the vertical movement of said cutting means.

* * * * *

UNITED STATES PATENT AND TRADEMARK OFFICE

CERTIFICATE OF CORRECTION

PATENT NO. : 4,175,455

DATED : November 27, 1979

INVENTOR(S) : James Genis and William T. Mars

It is certified that error appears in the above-identified patent and that said Letters Patent are hereby corrected as shown below:

Column 4, line 47, "satrting" should read --starting--.

Column 4, line 49, "premitted" should read --permitted--.

Column 4, line 61, "present" should read --preset--.

Column 5, line 16, "control" should be deleted.

Column 5, line 65, the word --same-- should be inserted after the words "At this".

Column 6, line 59, "3. Apparatus according to claim 2" should read --5. Apparatus according to claim 4--.

Column 6, line 64, "4. Apparatus according to claim 3" should read --6. Apparatus according to claim 5--.

Column 7, line 1, "5." should read --3.--.

Column 7, line 7, "6. Apparatus according to claim 5" should read --4. Apparatus according to claim 3--.

Signed and Sealed this

*Third* Day of *June 1980*

[SEAL]

*Attest:*

SIDNEY A. DIAMOND

*Attesting Officer*

*Commissioner of Patents and Trademarks*